US009672666B2

(12) United States Patent
Shin et al.

(10) Patent No.: US 9,672,666 B2
(45) Date of Patent: Jun. 6, 2017

(54) METHOD AND APPARATUS FOR COLLECTING VEHICLE DATA

(71) Applicant: HYUNDAI MOTOR COMPANY, Seoul (KR)

(72) Inventors: Dong Jin Shin, Suwon-si (KR); Sang Jae Han, Suwon-si (KR); Dong Youl Lee, Yongin-si (KR); Jae Am Seo, Seongnam-si (KR); Chul Min Kim, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/805,451

(22) Filed: Jul. 21, 2015

(65) Prior Publication Data

US 2016/0210795 A1 Jul. 21, 2016

(30) Foreign Application Priority Data

Jan. 20, 2015 (KR) ..... 10-2015-0009395

(51) Int. Cl.
*G07C 5/00* (2006.01)
*G07C 5/08* (2006.01)

(52) U.S. Cl.
CPC ..... *G07C 5/008* (2013.01); *G07C 5/08* (2013.01); *G07C 5/0841* (2013.01); *G07C 2205/02* (2013.01)

(58) Field of Classification Search
CPC ..... B60W 10/00; B60W 20/00; G08G 1/00; G07C 5/008; G07C 5/08; G07C 5/0841
See application file for complete search history.

(56) References Cited

U.S. PATENT DOCUMENTS

2006/0133454 A1* 6/2006 Beckwith ..... H04W 92/18 375/140
2011/0155389 A1* 6/2011 Burtz ..... G01V 99/00 166/369

(Continued)

FOREIGN PATENT DOCUMENTS

JP 2001-067592 A 3/2001
JP 2007-310733 A 11/2007

(Continued)

OTHER PUBLICATIONS

Notice of Allowance issued in corresponding Korean Patent Application No. 10-2015-0009395, mailed on Apr. 29, 2016.

*Primary Examiner* — Basil T Jos
(74) *Attorney, Agent, or Firm* — McDermott Will & Emery LLP

(57) ABSTRACT

A method and apparatus for collecting vehicle data is provided. The method for collecting vehicle data in a vehicle data collection server communicating with a vehicle through a wireless network includes receiving vehicle data corresponding to first to Nth data items from a first vehicle. When alternative data collection vehicles are needed, the method searches for the alternative data collection vehicles in a group of vehicles, for each of the first to Nth data items, receives vehicle data corresponding to at least one of the first to Nth data items through the searched alternative data collection vehicles, and stores the vehicle data received from the first vehicle and the vehicle data received from the alternative data collection vehicles.

19 Claims, 7 Drawing Sheets

(56) References Cited

U.S. PATENT DOCUMENTS

| | | | | |
|---|---|---|---|---|
| 2012/0046824 | A1* | 2/2012 | Ruther | B60R 16/0315 701/31.5 |
| 2012/0158910 | A1* | 6/2012 | Cooper | H04L 67/12 709/219 |
| 2013/0116915 | A1* | 5/2013 | Ferreira | G08G 1/163 701/117 |
| 2014/0222971 | A1* | 8/2014 | Cooper | H04L 67/12 709/219 |
| 2015/0310457 | A1* | 10/2015 | Smith | G06Q 30/0201 705/7.29 |

FOREIGN PATENT DOCUMENTS

| | | | |
|---|---|---|---|
| JP | 2008-027011 | A | 2/2008 |
| JP | 2008-070133 | A | 3/2008 |
| KR | 10-2013-0091984 | A | 8/2013 |
| KR | 10-2013-0123962 | A | 11/2013 |
| KR | 10-2014-0016463 | A | 2/2014 |
| WO | 2007/018766 | A2 | 2/2007 |

* cited by examiner

FIG. 5

510 520 530

| COLLECTED DATA ITEM | GROUP CRITERION | ALTERNATIVE EXCLUSION CRITERION |
|---|---|---|
| OUTSIDE TEMPERATURE SENSOR VALUE | CLOSELY LOCATED | SENSOR VALUE OUT OF NORMAL RANGE |
| RAINFALL SENSOR VALUE | CLOSELY LOCATED | SENSOR VALUE OUT OF NORMAL RANGE |
| SOLAR RADIATION SENSOR VALUE | CLOSELY LOCATED, SAME DRIVING DIRECTION | SENSOR VALUE OUT OF NORMAL RANGE |
| ROAD GRADIENT | CLOSELY LOCATED, SAME ROAD | NONE |
| NUMBER OF SHIFT STEPS | SAME CAR MODEL, SAME ENGINE/TRANSMISSION SPECIFICATION, SAME CAR SPEED, AND SAME APS | OCCURRENCE OF TRANSMISSION FAULT CODE |
| FUEL INJECTION AMOUNT | SAME CAR MODEL, SAME ENGINE/TRANSMISSION SPECIFICATION, SAME CAR SPEED, SAME APS, AND SAME RPM | OCCURRENCE OF ENGINE FAULT CODE |
| : | : | : |

500

METHOD AND APPARATUS FOR COLLECTING VEHICLE DATA

CROSS-REFERENCE TO RELATED APPLICATION

This application claims the benefit of priority to Korean Patent Application No. 10-2015-0009395, filed on Jan. 20, 2015 in the Korean Intellectual Property Office, the disclosure of which is incorporated herein in its entirety by reference.

TECHNICAL FIELD

The present disclosure relates to a method and apparatus for collecting vehicle data, and more particularly, to a method and apparatus for collecting vehicle data capable of distributing network load by adaptively selecting a data collection target vehicle for each collection target data item according to a predefined real-time grouping algorithm when collecting the vehicle data.

BACKGROUND

Some recently released vehicles are equipped with various electronic control devices for enhancing convenience and driver safety. These vehicles are basically equipped with an in-vehicle communication network for mutual communication between the electronic control devices.

In particular, with continuous increase in the number of in-vehicle electronic controllers and an enabled link with various external devices, an existing vehicle communication network may become overloaded and wiring harness-related costs may increase.

In addition, consumer demand for in-vehicle high-quality video and audio data and increase in applications using video requires extension of bandwidths.

In particular, research has been actively conducted into a big data platform for vehicles for collecting various types of data in a vehicle such as, for example, big data. The data can be collected in conjunction with a terminal for vehicles capable of performing wireless communication, for example, a vehicle head unit, and providing various services using the collected data.

However, as the amount of collected vehicle data increases, a bandwidth used for data transmission and a storage capacity of a server for storing collected vehicle data rapidly increase. As a result, cost for extension and operation of such systems has been increasing.

In addition, when various external systems require transmission of vehicle data through a wireless network, in-vehicle network load, for example, controller area network (CAN) bus load increases, which may adversely affect control and safety of the vehicle.

SUMMARY

Accordingly, the present disclosure is directed to a method and apparatus for collecting vehicle data that substantially obviates one or more problems due to limitations and disadvantages of the related art.

An object of the present disclosure is to provide a method and apparatus for collecting vehicle data capable of distributing network load by adaptively selecting a data collection vehicle for each collection target data item according to a predefined real-time grouping algorithm when collecting the vehicle data.

Another object of the present disclosure is to provide a method and apparatus for collecting vehicle data capable of reducing a data storage capacity by applying a variable data collection policy to prevent overlapping data collection for each group.

Another object of the present disclosure is to provide a method and apparatus for collecting vehicle data capable of distributing data collection in real time based on a driving environment for each vehicle.

Technical problems to be solved by the present disclosure are not limited to the above-mentioned technical problems, and other technical problems not mentioned herein may be clearly understood by those skilled in the art from description below.

The present disclosure relates to a method and apparatus for collecting vehicle data.

To achieve these objects and other advantages and in accordance with the purpose of the disclosure, as embodied and broadly described herein, a method for collecting vehicle data in a vehicle data collection server communicating with a vehicle through a wireless network includes receiving vehicle data corresponding to first to Nth data items from a first vehicle. The method includes, when alternative data collection vehicles are needed, searching for the alternative data collection vehicles in a group of vehicles, for each of the first to Nth data items. The method also includes receiving vehicle data corresponding to at least one of the first to Nth data items through the searched alternative data collection vehicles. The method further includes storing the vehicle data received from the first vehicle and the vehicle data received from the alternative data collection vehicles.

In another aspect of the present disclosure, a computer-readable recording medium storing a program for executing the described method is provided.

In another aspect of the present disclosure, an apparatus for collecting vehicle data communicating with a vehicle through a wireless network includes a communication unit for receiving vehicle data corresponding to first to Nth data items from a first vehicle through the wireless network. The apparatus includes a group criterion determination unit for searching for alternative data collection vehicles in a group of vehicles, for each of the first to Nth data items, wherein vehicle data corresponding to at least one of the first to Nth data items is received through the searched alternative data collection vehicles. The apparatus further includes a storage unit for storing the vehicle data received from the first vehicle and the vehicle data received from the alternative data collection vehicles.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the invention and together with the description serve to explain the principle of the disclosure. In the drawings:

FIG. 5 is a group criterion table showing a group criterion and an alternative exclusion criterion for each data item, according to an embodiment of the present invention.

DETAILED DESCRIPTION

Reference will now be made in detail to an apparatus and various methods to which the preferred embodiments of the present invention are applied. The suffixes "module" and "unit" of elements herein are used for convenience of description and thus can be used interchangeably and do not have any distinguishable meanings or functions.

Although all elements constituting the embodiments of the present invention are described as being integrated into a single one or operated as a single one, the present disclosure is not necessarily limited to such embodiments. According to embodiments, all of the elements may be selectively integrated into one or more and be operated as one or more within the object and the scope of the present disclosure. Each of the elements may be implemented as independent hardware. Alternatively, some or all of the elements may be selectively combined into a computer program having a program module performing some or all functions combined in one or more pieces of hardware. Code and code segments constituting the computer program may be easily reasoned by those skilled in the art to which the present disclosure pertains. The computer program may be stored in computer readable media such that the computer program is read and executed by a computer to implement embodiments of the present invention. Computer program storage media may include magnetic recording media, optical recording media, and carrier wave media.

The term "comprises", "includes", or "has" described herein should be interpreted not to exclude other elements but to further include such other elements since the corresponding elements may be inherent unless mentioned otherwise. All terms including technical or scientific terms have the same meanings as generally understood by a person having ordinary skill in the art to which the present disclosure pertains unless mentioned otherwise. Generally used terms, such as terms defined in a dictionary, should be interpreted to coincide with meanings in the related art from the context. Unless obviously defined in the present disclosure, such terms are not interpreted as having ideal or excessively formal meanings.

It will be understood that, although the terms first, second, A, B, (a), (b), etc. may be used herein to describe various elements of the present disclosure, these terms are only used to distinguish one element from another element and essential, order, or sequence of corresponding elements are not limited by these terms. It will be understood that when one element is referred to as "connected to", "coupled to", or "accessing" another element, one element may be "connected to", "coupled to", or "access" another element via a further element although one element may be directly connected to or directly access another element.

Figure 1:
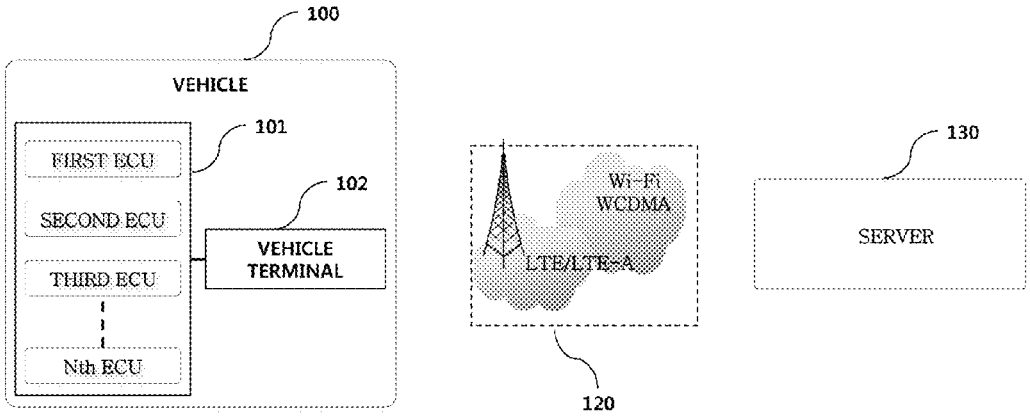
FIG. 1 is a block diagram illustrating a configuration of a system for collecting vehicle data, according to the related art.

FIG. 1 illustrates a configuration of a system for collecting vehicle data according to the related art.

The system for collecting vehicle data according to the related art may largely include a vehicle 100, a mobile communication network 120, and a data collection server 130.

The vehicle 100 may include first to nth electronic control units (ECUs) 101 and a vehicle terminal 102, and the vehicle terminal 102 may be linked to the data collection server 130 through the mobile communication network 120.

For example, the data collection server 130 requests, through a predetermined control signal, that the vehicle terminal 102 collect data of a particular vehicle. In response to the request for data collection, the vehicle terminal 102 collects corresponding vehicle data from the corresponding ECUs, and then transmits the collected vehicle data to the data collection server 130 through the mobile communication network 120.

However, the data collection server 130 according to the related art requests the vehicle terminal 102 to collect data without considering network load in the vehicle and a vehicle driving environment, and thus a network in the vehicle may be overloaded, which adversely affects control and safety of the vehicle.

Moreover, the data collection server 130 according to the related art has disadvantages in that a large transmission bandwidth is required since the same vehicle data is simultaneously received from a set of vehicles and a large storage space is consumed to store repeatedly collected vehicle data.

Figure 2:
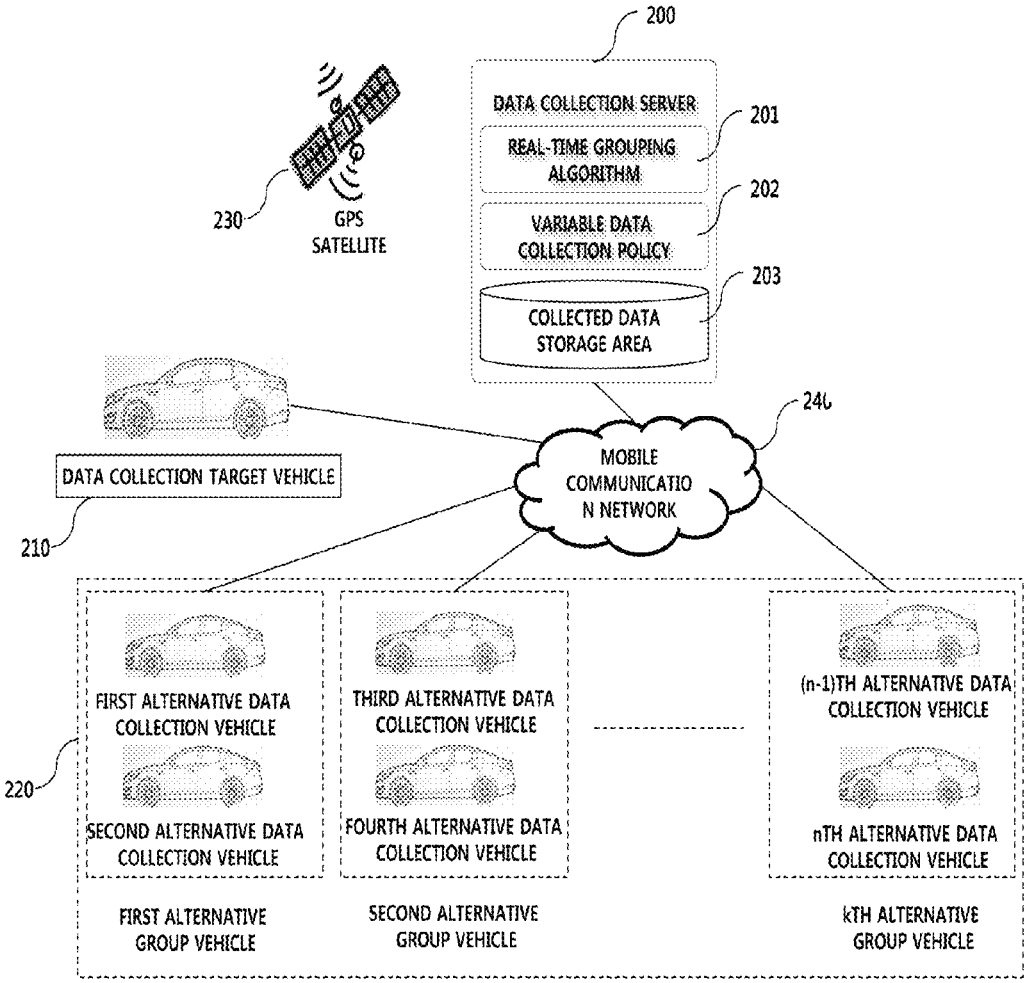
FIG. 2 is a block diagram illustrating a configuration of a system for collecting vehicle data, according to an embodiment of the present invention.

FIG. 2 illustrates a configuration of a system for collecting vehicle data according to the present disclosure.

Referring to FIG. 2, the system for collecting vehicle data according to the present disclosure may include a data collection server 200, a data collection target vehicle 210, first to kth alternative group vehicles 220, a global positioning system (GPS) satellite 230, a mobile communication network 240, etc.

The data collection server 200 may determine whether an alternative data collection vehicle is needed according to a real-time grouping algorithm 201 included therein, and perform a control operation such that some or all data items among data items which are currently being collected from the data collection target vehicle 210 are collected from another vehicle, that is, the alternative data collection vehicle according to a result of determination.

To this end, the data collection server 200 may perform a control operation such that an alternative data collection vehicle for each group corresponding to a particular data item is identified according to a predefined criterion for the group, and the data item corresponding to the group is collected from the identified alternative data collection vehicle. Here, a set of alternative data collection vehicles may be included in each group. The data collection server 200 may dynamically select an alternative data collection vehicle expected to collect the corresponding data item in the group or remove an alternative data collection vehicle in the group from the group based on a predefined variable data collection policy 202. A new alternative data collection vehicle may be additionally included in the group.

The criterion for the group according to the present embodiment may be defined based on information about a current location of a vehicle, information about a road on which a vehicle is currently driven, information about a model and specifications of a vehicle, information about driving conditions, etc.

The current location of the vehicle may be measured by a global positioning system (GPS) module included in the vehicle, and a vehicle terminal having a wireless communication function may transmit the measured location information to the data collection server 200 through the mobile communication network 240.

The data collection server 200 may identify the road on which the vehicle is currently driven by mapping the current location information of the vehicle onto a road map stored in advance.

In addition, the data collection server 200 may identify a driving direction corresponding to a direction in which the vehicle is moving on the identified road by monitoring a change in location of the vehicle.

The data collection server 200 may identify the type and specifications, for example, a displacement and option information of the vehicle based on vehicle information stored in advance.

The data collection server 200 may acquire the driving condition information based on vehicle data collected in real time from the vehicle. For example, the driving condition information may include information about a speed of the vehicle, information about revolutions per minute (RPM), information about an accelerator position sensor (APS), etc.

As an example, in a data item related to an outside temperature of the vehicle (hereinafter, simply referred to as an outside temperature sensor value), current location information of the vehicle may be defined as the criterion for the group. Since vehicles close to each other have the same outside temperature sensor value, the current location of the vehicle may be used as the criterion for the group.

As another example, in a data item related to the number of shift steps, whether vehicles of models having the same engine and transmission have the same speed and APS value may be used as the criterion for the group. Since the number of shift steps are determined based on the speed and the APS value, it is possible to assume that vehicles having the same speed and APS value have the same the number of shift steps.

As described in the foregoing, it should be noted that a criterion for a group for each of various data items may be defined by combining the criteria for the group described above according to a collection target data item. For example, in a data item related to a solar radiation sensor value, it may be preferable that vehicles having the same driving direction at locations close to each other being set to the same group, and then data to be collected from vehicles included in the group.

The data collection server 200 may determine whether to exclude a vehicle from data collection targets based on real-time vehicle state information of an alternative data collection vehicle for each group identified based on the criterion for the group described above, and a validity evaluation of collected vehicle data.

Here, the vehicle state information may include whether a vehicle controller has failed (for example, including whether a transmission has failed, whether an engine has failed, whether a rain sensor has failed, whether a brake has failed, etc.), whether the network in the vehicle is overloaded, whether wireless communication is normal, etc.

In addition, the validity evaluation of the collected vehicle data may be performed based on a normal range of a sensor value predefined for each data item. For example, when vehicle data outside the normal range is continuously received a predetermined number of times or more, the data collection server 200 may exclude the corresponding vehicle from the data collection targets.

The data collection server 200 according to the present disclosure may include a collected data storage area 203 for storing data collected by each vehicle. Alternatively, the collected data storage area 203 may be included in another device physically separated from the data collection server 200, and the data collection server 200 may store/change/read data by accessing the collected data storage area 203 through a predetermined communication interface.

In particular, the data collection server 200 may minimize network load by dynamically allocating collection target data items to respective vehicles in the same group such that repeated data is not collected for a data item in which the same or similar data is expected to be collected from vehicles included in the same group.

In addition, the data collection server 200 may establish a link, which refers to an address in which actually collected data is stored, in the collected data storage area 203 for a data item in which repeated reception is expected in the same group to prevent repeated data from being stored in the same group, thereby minimizing use of a storage space.

Figure 3:
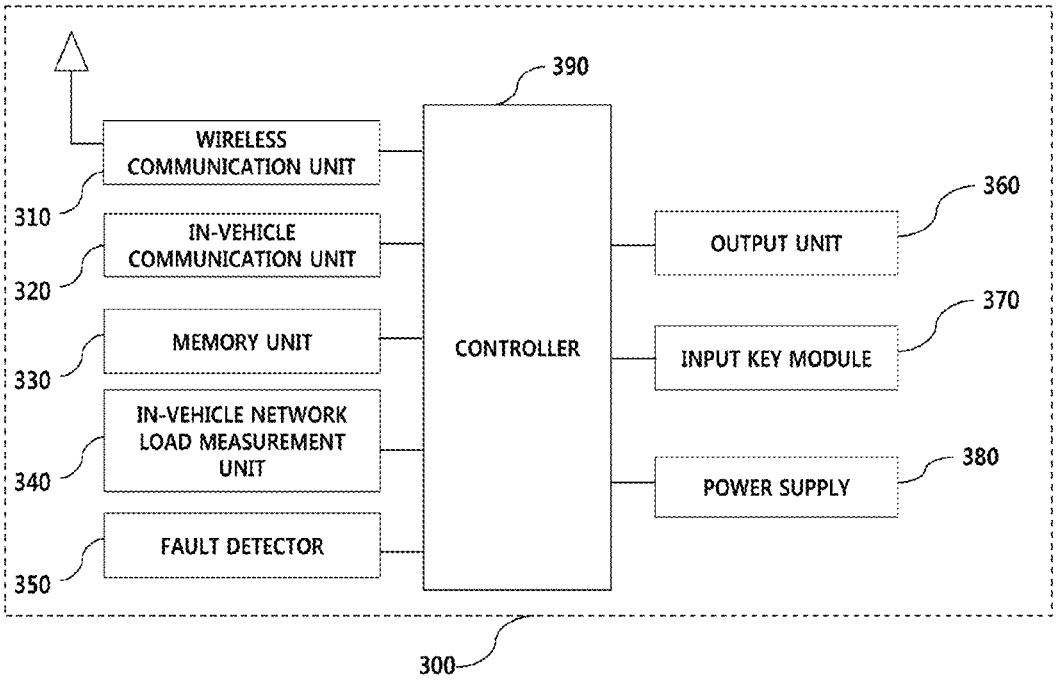
FIG. 3 is a block diagram illustrating an internal configuration of a vehicle data collection terminal, according to an embodiment of the present invention.

FIG. 3 illustrates an internal configuration of a vehicle data collection terminal 300 according to an embodiment of the present invention.

The vehicle data collection terminal 300 is included in the vehicle, and may be linked to the data collection server 200 through the mobile communication network 240.

The vehicle data collection terminal 300 according to the present embodiment may include a wireless communication unit 310, an in-vehicle communication unit 320, a memory unit 330, an in-vehicle network load measurement unit 340, a fault detector 350, an output unit 360, an input key module 370, a power supply 380, a controller 390, etc.

The wireless communication unit 310 may include at least one of a broadcast reception module, a mobile communication module, a wireless Internet communication module, a local-area communication module, and a GPS module.

The broadcast reception module receives a broadcast signal and/or broadcasting-related information from an external broadcasting management server through a broadcasting channel. Here, the broadcasting channel may include a satellite channel and a terrestrial channel.

The mobile communication module performs a function for transmitting/receiving a radio signal to/from a base station, a relay station, a repeater, a femto cell, a remote radio head (RRH), etc., through a wireless interface of a mobile communication network. Here, the radio signal may include a voice call signal, a video call signal, and a data signal having various forms according to transmission and reception of a text/multimedia message. In particular, the vehicle data collection terminal 300 according to the present disclosure may receive a vehicle data collection request signal of the data collection server 200 and transmit vehicle data collected therein to the data collection server 200 using the mobile communication module. In addition, the vehicle data collection terminal 300 may perform a predetermined authentication procedure for collecting vehicle data with the data collection server 200 through the mobile communication network 240.

The mobile communication module refers to a transmission/reception module for wireless Internet access, and the mobile communication module may be provided on the inside of the vehicle data collection terminal 300 or on the outside thereof through a certain interface terminal. Examples of a wireless Internet technology may include wireless local area network (WLAN), Wi-Fi, wireless broadband (WiBro), worldwide interoperability for microwave access (WiMax), etc.

The local-area communication module refers to a module for local-area communication. Examples of local-area communication technology include Bluetooth, radio frequency identification (RFID), infrared data association (IrDA), ultra wide band (UWB), ZigBee, etc. The vehicle data collection terminal 300 may be connected to a user terminal (for example, a smartphone or wearable device) using the local-area communication module, and a vehicle driver may perform an authentication procedure for collecting vehicle data on the user terminal connected through local-area communication.

The GPS module is a module for identifying or acquiring current location information of a vehicle using a signal received from the GPS satellite 230. In this instance, the acquired vehicle location information may be transmitted to the data collection server 200 through the mobile communication network 240.

The in-vehicle communication unit 320 provides a function for communication with various ECUs and sensors in the vehicle. The in-vehicle communication unit 320 may transmit a predetermined control signal of the controller 390 to the ECUs or the sensors, or deliver vehicle data received from the ECUs or the sensors to the controller 390.

The memory unit 330 may store a program for operation of the controller 390, and may temporarily store input/output data (for example, vehicle data, vehicle data collection authentication information, menu setting information, a still image, a moving image, a sound effect, an application program, etc.).

The in-vehicle network load measurement unit 340 may perform a function for measuring traffic load on an in-vehicle network (for example, a CAN, an in-vehicle Ethernet communication network, FlexRay, media oriented systems transport (MOST), a local interconnect network (LIN), etc.), and detecting whether the network is overloaded by comparing the measured traffic load with a predetermined reference value. When the in-vehicle network load measurement unit 340 detects network overload and transmits a predetermined overload detection signal to the controller 390, the controller 390 may transmit a predetermined warning signal indicating occurrence of network overload in the vehicle to the data collection server 200 through the mobile communication network 240.

The fault detector 350 may detect whether an ECU of the vehicle has failed, and transmit a result of detection to the controller 390. The controller 390 may transmit a fault code corresponding to a detected fault to the data collection server 200 through the mobile communication network 240.

The output unit 360 is used to generate audio, visual or tactile output. The output unit 360 may include a display module, a sound output module, an alarm module, etc.

The display module may be used as an input device in addition to an output device when a sensor for sensing a touch operation (hereinafter, referred to as a touch sensor) has a mutual layer structure (hereinafter, simply referred to as a touch screen).

The sound output module may output audio data received from the wireless communication unit 310 or stored in the memory unit 330 in a call signal reception mode, an alarm mode, a voice call mode, a video call mode, a voice recognition mode, a broadcast reception mode, a navigation mode, etc.

The alarm module outputs a signal for reporting occurrence of an event of the vehicle data collection terminal 300. Here, examples of the event occurring in the vehicle data collection terminal 300 include a start of voice recognition, an end of voice recognition, display of voice recognition result, reception of a call signal, reception of a message, a key signal input, a touch input, reception of a signal for requesting vehicle data collection authentication, occurrence of network overload, detection of a controller fault, etc. In addition, the alarm module may output another type of signal other than a video signal or an audio signal, for example, a signal for reporting an occurrence of an event using a light-emitting device. The video signal and the audio signal may be output through the display module or the sound output module.

The input key module 370 generates an input signal used when a driver controls an operation of the vehicle data collection terminal 300. The input key module 370 may include a keypad, a dome switch, a (constant pressure/capacitive) touch panel, a jog wheel, a jog switch, etc.

The power supply 380 supplies power used to operate the vehicle data collection terminal 300.

In general, the controller 390 controls an overall operation of the vehicle data collection terminal 300. For example, the controller 390 may provide a function for controlling the output unit 360, etc. in addition to various communication functions including a voice call service, a data communication service, a video call service, wireless Internet connection, local-area communication connection, etc.

The controller 390 according to the present disclosure may perform a function for collecting vehicle data from various controllers and sensors in the vehicle in response to a request for collection of the vehicle data from the data collection server 200, and providing the vehicle data to the data collection server 200.

Figure 4:
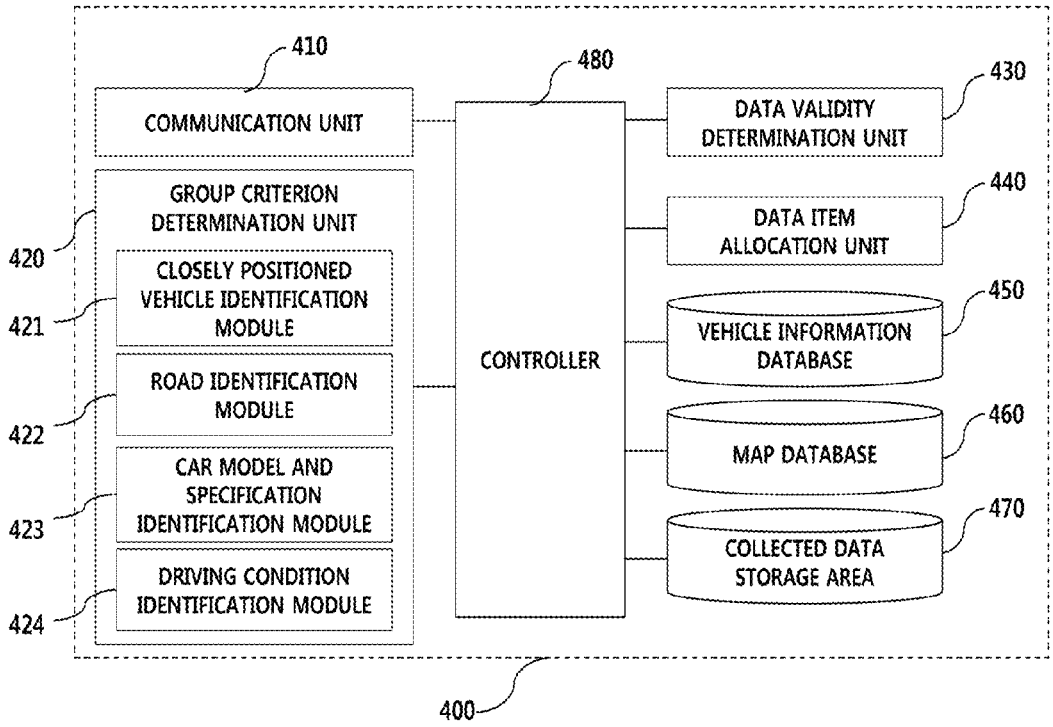
FIG. 4 is a block diagram illustrating an internal configuration of a vehicle data collection server, according to an embodiment of the present invention.

FIG. 4 illustrates an internal configuration of a vehicle data collection server 400 according to an embodiment of the present invention.

Referring to FIG. 4, the vehicle data collection server 400 may include a communication unit 410, a group criterion determination unit 420, a data validity determination unit 430, a data item allocation unit 440, a vehicle information database 450, a map database 460, a collected data storage area 470, and a controller 480.

The communication unit 410 communicates with an external device. In particular, the communication unit 410 may communicate with the vehicle data collection terminal 300 through the mobile communication network 240.

The group criterion determination unit 420 performs a function for identifying a group including a corresponding vehicle based on a predefined criterion for the group for each data item.

The group criterion determination unit 420 according to the present embodiment may include a closely positioned vehicle identification module 421, a road identification module 422, a car model and specification identification module 423, and a driving condition identification module 424.

The closely positioned vehicle identification module 421 performs a function for identifying vehicles located within a predetermined distance (for example, within a 5 km-radius) from a particular vehicle as a closely positioned group of the particular vehicle based on current location information collected from respective vehicles.

The road identification module 422 performs a function for identifying a currently used road by mapping current location information collected from respective vehicles to road map information stored in advance, and identifying vehicles driven on the same road/in the same direction as that of a particular vehicle near the particular vehicle as a same road group of the particular vehicle.

The car model and specification identification module 423 performs a function for identifying vehicles having the same car model/specification as that of a particular vehicle based on vehicle information stored in the vehicle information database 450, and identifying the identified vehicles as a same car model/specification group of the particular vehicle.

The driving condition identification module 424 performs a function for identifying vehicles, various driving conditions such as a speed, an APS value, a gear shifting step, etc. of which are within predetermined differences, as a same driving condition group. For example, vehicles currently driven at constant speeds within a difference of 10 km/h or less may be determined to be the same driving condition group.

The group criterion determination unit 420 may determine a group corresponding to a collection target data item based on a result of identification of at least one of the identification modules 421 to 423 according to the collection target data item.

In general, vehicles having the same car model, specifications, speed, and APS value may have the same number of shift steps. Therefore, when the collection target data item corresponds to the number of shift steps, the group criterion determination unit 420 may identify a group corresponding to the number of shift steps based on results of identifying groups by the car model and specification identification module 423 and the driving condition identification module 424.

The data validity determination unit 430 performs a function for determining a validity of collected vehicle data. For example, the data validity determination unit 430 may identify a vehicle from which invalid vehicle data (for example, data out of a normal range of a sensor value) is continuously received a predetermined number of times or more, and deliver a result of identification to the controller 480. In this instance, the controller 480 may exclude the vehicle, from which the invalid vehicle data is received, from data collection target vehicles.

The data item allocation unit 440 performs a function for allocating data items to be collected by vehicles included in the same group as the respective vehicles. In this instance, the data item allocation unit 440 may allocate data items to be collected from respective vehicles in the same group such that repeated data is not received for a data item in which the same or similar data is expected to be received from vehicles included in the same group. In addition, the data item allocation unit 440 may exclude a vehicle from which invalid data is received from a data item allocation target according to a result of determination of the data validity determination unit 430.

In addition, when a new vehicle is additionally included in the group or a vehicle is excluded from the group in response to a change in vehicle driving environment, the data item allocation unit 440 may dynamically reallocate data items to be collected from respective vehicles by reflecting the additionally included or excluded vehicle in real time.

The vehicle information database 450 may store information about a car model/specifications/options, etc. for each vehicle. Here, the vehicle may be identified by a vehicle identification number (VIN) unique to each vehicle. To this end, the data collection server 400 may identify the car model/specifications/options of the vehicle by receiving VIN information in a step of establishing a communication link through authentication with the vehicle data collection terminal 300.

The map database 460 may store road map information for identifying a road on which the vehicle is currently driven.

The collected data storage area 470 may store vehicle data collected from the vehicle and divided based on each data item. In this instance, a link may be established to a data item in which the same or similar data is expected to be collected in the same group such that an address in which an actual data value is stored, is referred to.

The controller 480 performs a function for controlling an overall operation of the vehicle data collection server 400.

FIG. 5 illustrates a group criterion table 500 showing a group criterion 520 and an alternative exclusion criterion 530 for each data item according to an embodiment of the present invention.

Referring to FIG. 5, at least one group criterion 520 may be applied to each collected data item 510 in the group criterion table 500. For example, one group criterion 520 of "closely located" may be applied to an outside temperature sensor value, and a combination of two group criteria 520 of "closely located" and "the same driving direction" may be applied to a solar radiation sensor value.

In addition, the alternative exclusion criterion 530 may be defined for each collected data item 510 in the group criterion table 500. For example, when the collected data item 510 corresponds to the outside temperature sensor value, and a collected outside temperature sensor value is found to be out of a normal range, the vehicle data collection server 400 may exclude a vehicle transmitting the corresponding data from alternative vehicles for collecting the corresponding data item.

Figure 6:
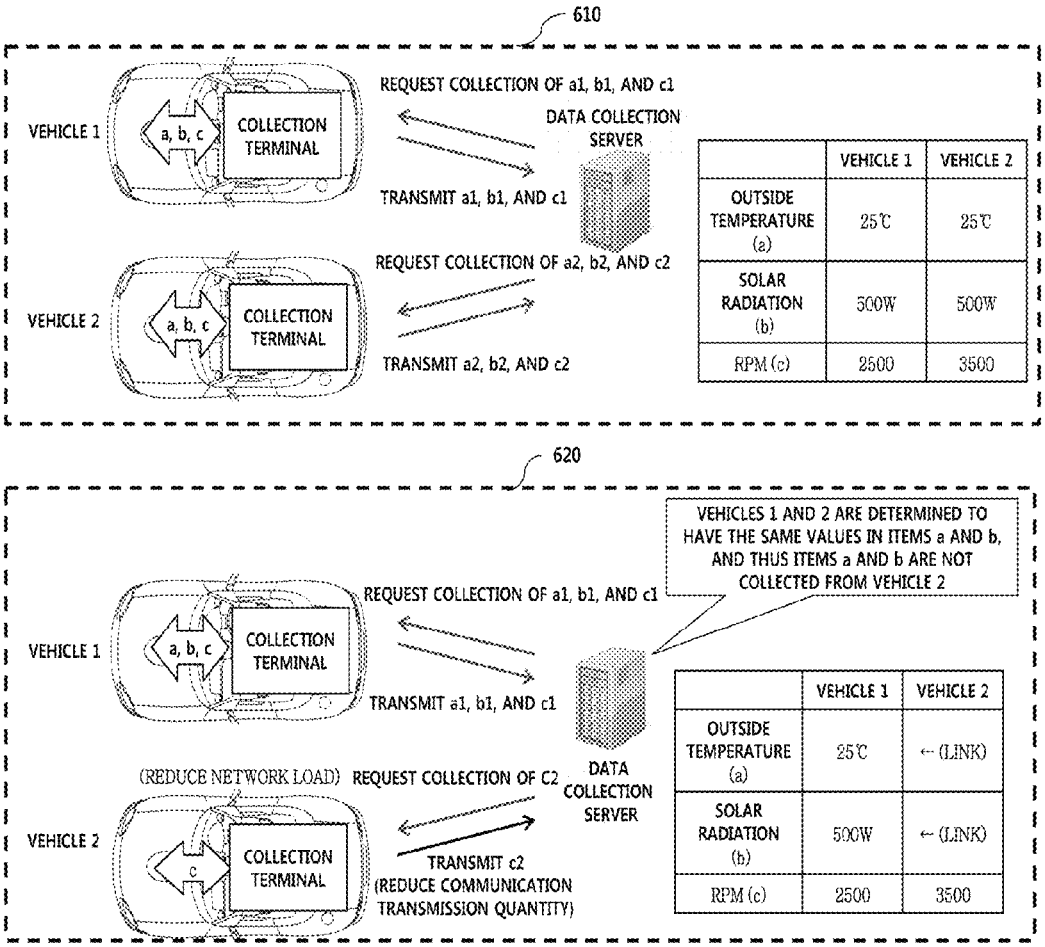
FIG. 6 is a diagram illustrating a difference in a method for collecting vehicle data between an embodiment of the present invention and the related art.

FIG. 6 illustrates a difference in a method for collecting vehicle data between the present disclosure and the related art.

Referring to reference numeral 610, in the method for collecting vehicle data according to the related art, data items of a (outside temperature), b (solar radiation), and c (RPM) are collected from each of vehicle 1 and vehicle 2 by a data collection server, and the values of a, b and c collected from each vehicle are stored and maintained in a collected data storage area.

However, referring to reference numeral 610, upon receiving the same values of the data items a and b from vehicle 1 and vehicle 2, the conventional data collection server stores the values in the collected data storage area without change.

Referring to reference numeral 620, the method for collecting vehicle data according to the present disclosure is characterized such that a data item in which the same value is expected to be received from vehicle 1 and vehicle 2 is identified among data collection target items based on a characteristic of a group including corresponding vehicles. The data items to be collected are allocated to respective vehicles such that the same value is not repeatedly received. As illustrated in a box indicated by reference numeral 620, when the same values are determined to be received in the data items a and b, a data collection server may perform a control operation such that vehicle 1 collects and transmits values of the data items of a, b and c, and vehicle 2 collects and transmits only a value of the data item c. In addition, the data collection server may minimize memory consumption by establishing a link for referring to an address in which actual data is stored for an item having the same data value in the group in the collected data storage area.

As described above with reference to FIG. 6, the method for collecting vehicle data according to the present disclosure may not only effectively reduce communication transmission quantity in a wireless section but also reduce network load in vehicles by adaptively allocating data items to be collected to the respective vehicles in the group.

Figure 7:
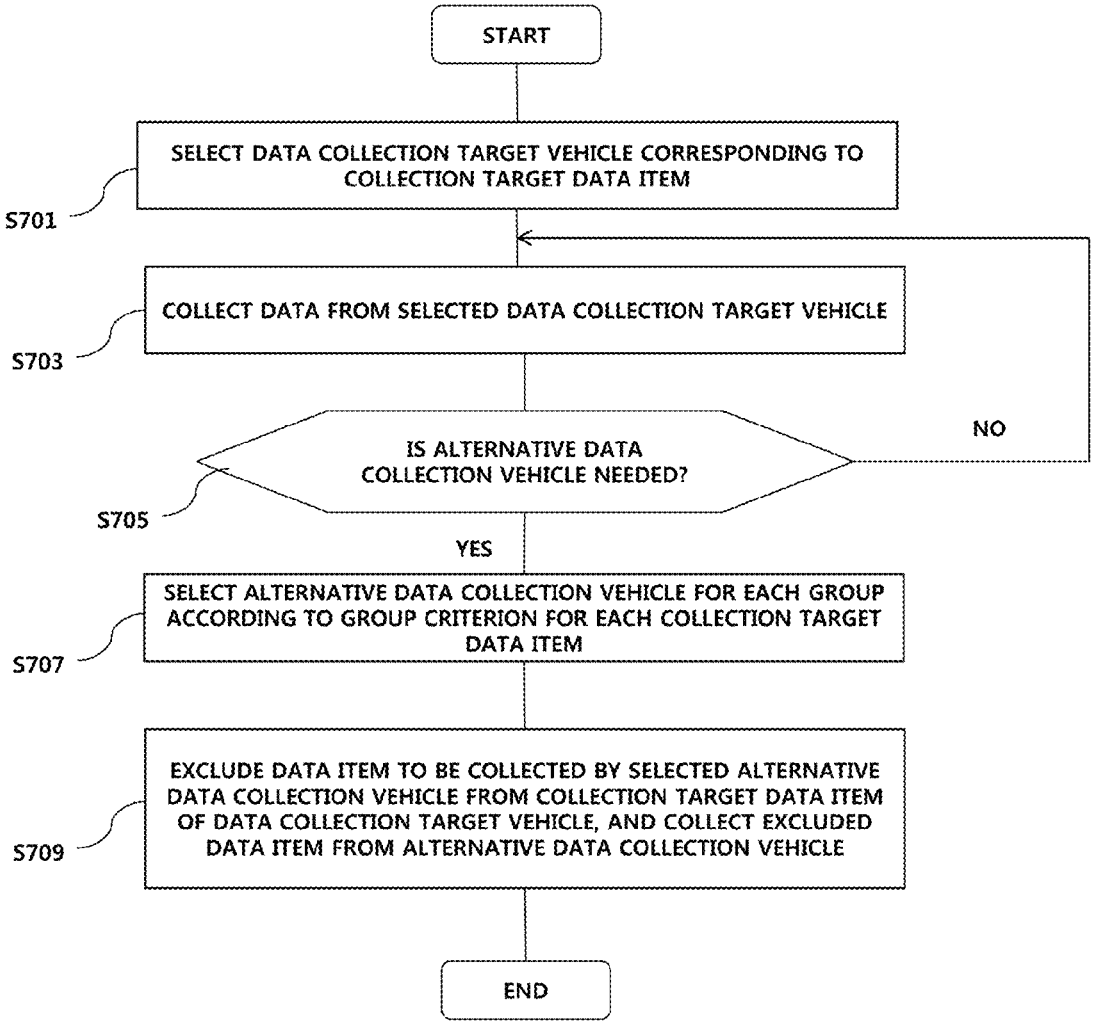
FIGS. 7 to 9 are flowcharts illustrating methods for collecting vehicle data, according to embodiments of the present invention.
Figure 8:
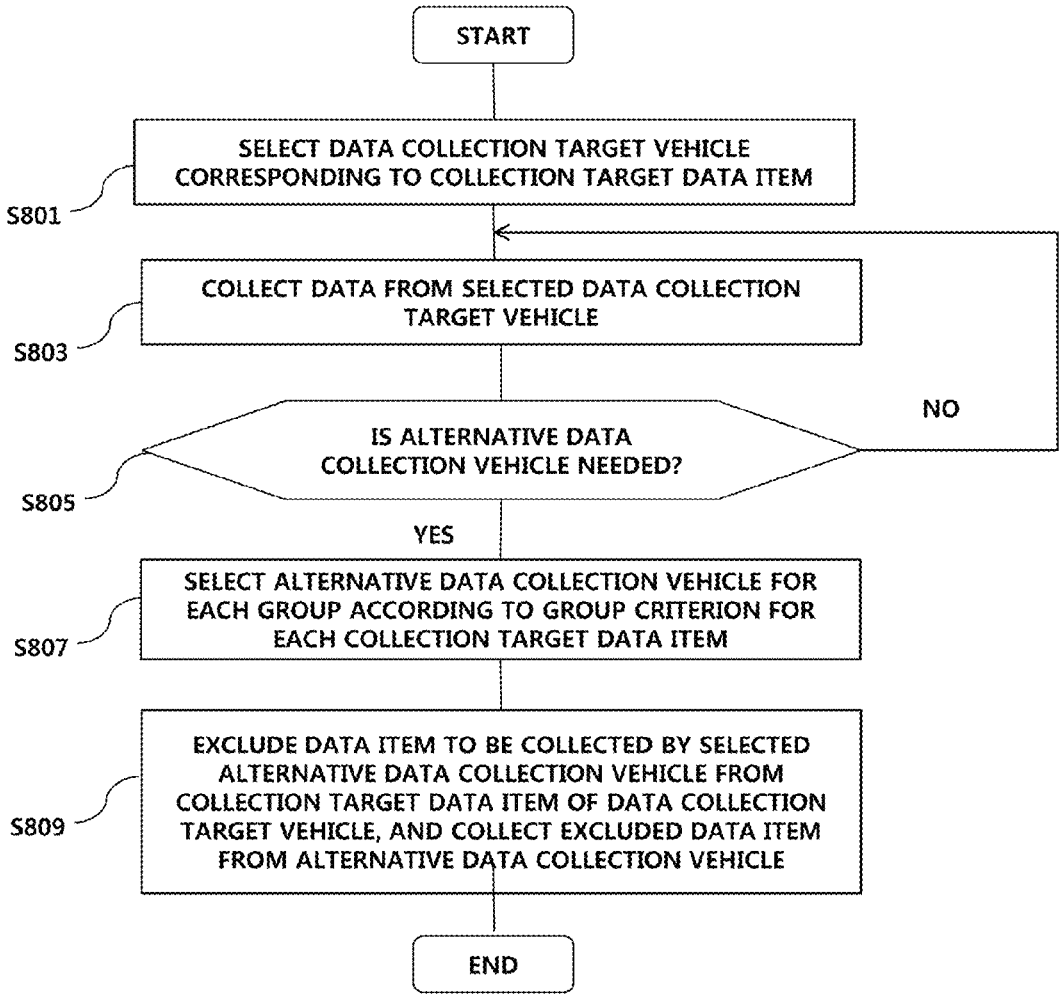
Figure 9:
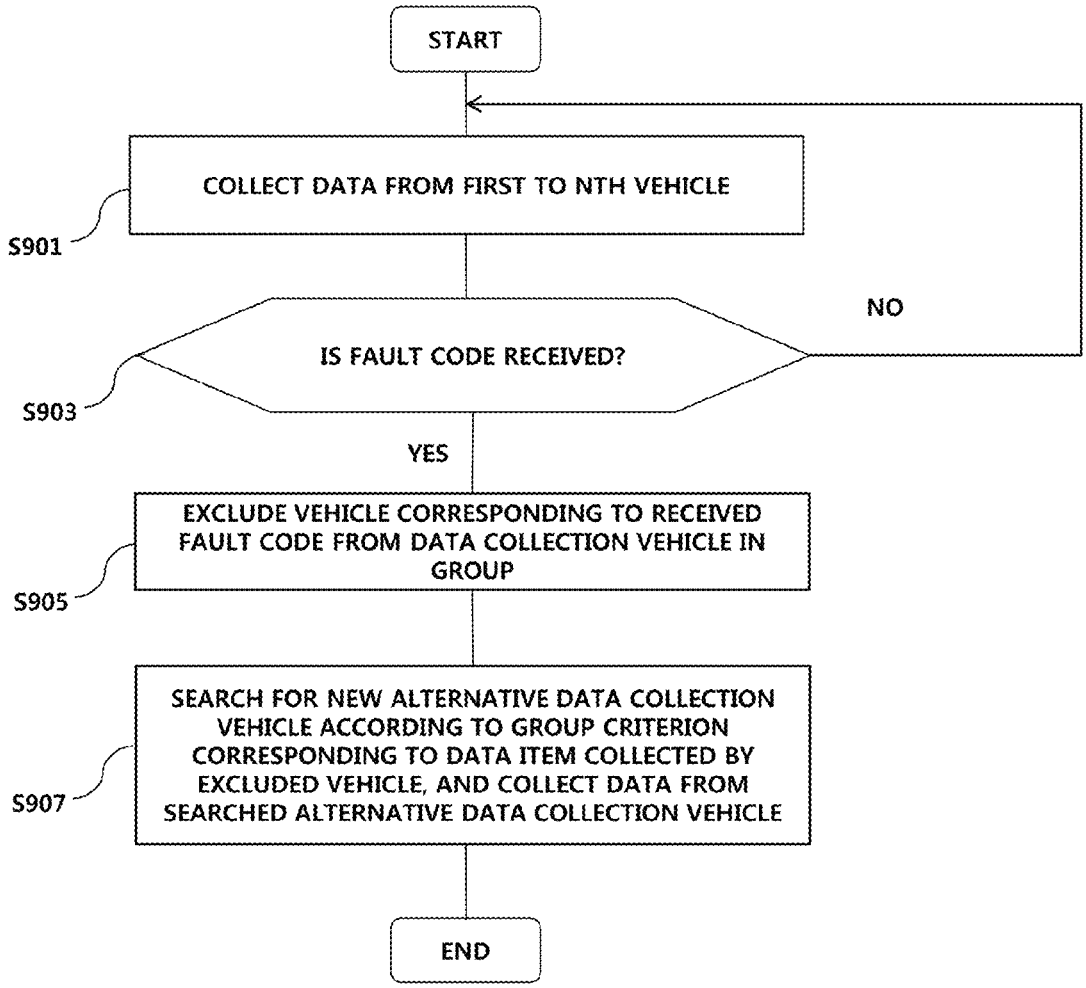

FIGS. 7 to 9 illustrate methods for collecting vehicle data according to embodiments of the present invention.

FIG. 7 illustrates a method for collecting vehicle data in the data collection server 400 according to an embodiment of the present invention.

Referring to FIG. 7, at blocks S701 to S703, the data collection server 400 may select a data collection target vehicle corresponding to a collection target data item, and collect data from the selected data collection target vehicle.

At S705, the data collection server 400 determines whether an alternative data collection vehicle is needed while collecting data. For example, when network load in the selected data collection target vehicle is greater than or equal to a reference value, or when a wireless communication quality with respect to the selected data collection target vehicle is below a reference value, the data collection server 400 may determine that the alternative data collection vehicle is needed.

When the alternative data collection vehicle is needed as a result of determination, the data collection server 400 may search a group based on a predefined group criterion for each collection target data item, and select an alternative data collection vehicle for each searched group at S707.

At S709, the data collection server 400 may allocate a data item to be collected by the selected alternative data collection vehicle, and exclude the data item allocated to the alternative data collection vehicle from the collection target data item of the data collection target vehicle. The excluded data item may be collected from the alternative data collection vehicle.

FIG. 8 illustrates a method for collecting vehicle data according to another embodiment of the present invention.

Referring to FIG. 8, at blocks S801 to S803, the data collection server 400 determines validity of collected vehicle data for each vehicle while collecting data from first to Nth vehicles.

When there is a vehicle from which invalid vehicle data is received as a result of determination, the data collection server 400 excludes the vehicle from which the invalid vehicle data is received from data collection vehicles in a corresponding group at blocks S805 to S807.

Subsequently, at S809, the data collection server 400 may search for a new alternative data collection vehicle based on a group criterion corresponding to a data item collected from the excluded vehicle, and collect the corresponding data from the searched alternative data collection vehicle.

FIG. 9 illustrates a method for collecting vehicle data according to another embodiment of the present invention.

Referring to FIG. 9, at blocks S901 to S903, the data collection server 400 may verify whether a fault code is received while collecting data from first to Nth vehicles.

When the fault code is received as a result of verification, the data collection server 400 may exclude a vehicle corresponding to the received fault code, that is, a vehicle transmitting the fault code from data collection vehicles at S905.

At S907, the data collection server 400 may search for a new alternative data collection vehicle based on a group criterion corresponding to a data item collected from the excluded vehicle, and collect data by allocating the data item to the searched new alternative data collection vehicle.

Effects of the method and apparatus of the present disclosure are described below.

First, the present disclosure has an advantage in that network load is effectively distributed by applying a data collection vehicle distribution policy to an apparatus for collecting vehicle data.

Second, the present disclosure has an advantage of providing a method and apparatus for collecting vehicle data capable of distributing network load in a vehicle by adaptively selecting data collection vehicles for each collection target data item according to a predefined real-time grouping algorithm when collecting the vehicle data.

Third, the present disclosure has an advantage of providing a method and apparatus for collecting vehicle data capable of reducing a data storage capacity by applying a variable data collection policy to prevent repeated data collection for each group.

Fourth, the present disclosure has an advantage in that unnecessary data is prevented from being collected in advance and data collection efficiency is enhanced by adaptively selecting data collection target vehicles based on a wireless communication state, validity of collected data, a vehicle state, etc.

Fifth, the present disclosure has an advantage of enhancing communication stability in a vehicle by reducing network load in the vehicle.

Those skilled in the art will appreciate that the present disclosure may be carried out in other specific ways than those set forth herein without departing from the spirit and essential characteristics of the present disclosure.

The above exemplary embodiments are therefore to be construed in all aspects as illustrative and not restrictive. The scope of the disclosure should be determined by the appended claims and their legal equivalents, not by the above description, and all changes coming within the meaning and equivalency range of the appended claims are to be embraced therein.

What is claimed is:

1. A method for collecting vehicle data by a vehicle data collection server communicating with a vehicle through a wireless network, the method comprising:

communicating, at a communication unit, with plural vehicles including a subject vehicle via the wireless network;

determining, at a group criterion determination unit, which vehicle among the plural vehicles is considered an alternative data collection vehicle group for the subject vehicle based on a predefined group criterion;

determining, at a data validity determination unit, which one of vehicle data gathered from the alternative data collection vehicle group via the wireless network is an overlapped feature to the subject vehicle;

assigning, at a data item allocation unit, the overlapped feature to subject vehicle data belonging to the subject vehicle;

sending, at the communication unit, a message for requesting an incomplete data item of the subject vehicle data at the subject vehicle via the wireless network;

receiving, at the communication unit, another message including vehicle data, corresponding to the incomplete data item, delivered from the subject vehicle via the wireless network; and updating, at a controller, the subject vehicle data stored in a data storage in response to the vehicle data received from the subject vehicle.

2. The method according to claim 1, further comprising:
allocating each data item of the subject vehicle data to be received from the subject vehicle to the alternative data collection vehicle group such that the vehicle data is not repeatedly received from the subject vehicle and the alternative data collection vehicle group.

3. The method according to claim 1, further comprising:
determining validities of the vehicle data received from the subject vehicle and the alternative data collection vehicle group; and
when the vehicle data delivered from an alternative vehicle in the alternative data collection vehicle group is invalid, excluding the alternative vehicle for further data collection.

4. The method according to claim 1, further comprising:
when a fault code is received from the subject vehicle or from one of the alternative data collection vehicle group, performing a control operation such that the subject vehicle data or the vehicle data corresponding to the fault code is excluded from data collection.

5. The method according to claim 1, further comprising:
determining whether there is a network overload with the subject vehicle.

6. The method according to claim 1, further comprising:
determining whether a quality of the vehicle data received from the subject vehicle is lower than a reference value.

7. The method according to claim 1, wherein the predefined group criterion comprises at least one of information about a location of the vehicle, information about a road on which the vehicle is currently driven, information about a driving condition of the vehicle, and information about a vehicle model and vehicle specification.

8. The method according to claim 1, wherein the overlapped feature is not duplicated or copied in a data storage, further comprising:
establishing a link established to an address in which actual vehicle data of the data item is stored so as to assign the overlapped feature to the subject vehicle data.

9. The method according to claim 1, wherein the incomplete data item of the subject vehicle data is concerned with either the vehicle data received through one of the alternative data collection vehicle group but considered invalid or the subject vehicle data having an inherent feature for each vehicle.

10. A non-transitory computer-readable recording medium recorded with a computer program product to be executed by a computing device, wherein the computing device is configured to execute the computer program product comprising a code or code segments to perform:
communicating, at a communication unit, with plural vehicles including a subject vehicle via a wireless network;
determining, at a group criterion determination unit, which vehicle among the plural vehicles is considered an alternative data collection vehicle group for the subject vehicle based on a predefined group criterion;
determining, at a data validity determination unit, which one of vehicle data gathered from the alternative data collection vehicle group via the wireless network is an overlapped feature to the subject vehicle;
assigning, at a data item allocation unit, the overlapped feature to subject vehicle data belonging to the subject vehicle;
sending, at the communication unit, a message for requesting an incomplete data item of the subject vehicle data at the subject vehicle via the wireless network;
receiving, at the communication unit, another message including vehicle data corresponding to the incomplete data item from the subject vehicle; and
updating, at a controller, the subject vehicle data stored in a data storage in response to the vehicle data received from the subject vehicle.

11. An apparatus for collecting vehicle data and communicating with a vehicle through a wireless network, the apparatus comprising:
a communication unit for communicating with plural vehicles including a subject vehicle through the wireless network, sending a message for requesting an incomplete data item of the subject vehicle data at the subject vehicle via the wireless network, and receiving another message including vehicle data corresponding to the incomplete data item from the subject vehicle;
a group criterion determination unit for determining which vehicle among the plural vehicles is considered an alternative data collection vehicle group for the subject vehicle based on a predefined group criterion;
a data validity determination unit for determining which one of vehicle data gathered through the communication unit from the alternative data collection vehicle group via the wireless network is an overlapped feature to the subject vehicle; and
a controller for updating the subject vehicle data stored in a data storage in response to the vehicle data received through the communication unit from the subject vehicle.

12. The apparatus according to claim 11, further comprising:
a data item allocation unit for allocating each data item of the subject vehicle data to be received from the subject vehicle to the alternative data collection vehicle group such that the vehicle data is not repeatedly received from the subject vehicle and the alternative data collection vehicle group.

13. The apparatus according to claim 12, wherein the data item allocation unit assigns the overlapped feature to subject vehicle data belonging to the subject vehicle.

14. The apparatus according to claim 11, further comprising
a data validity determination unit for determining validities of the vehicle data received from the subject vehicle and the alternative data collection vehicle group,
wherein, when the vehicle data is invalid, a vehicle transmitting the invalid vehicle data is excluded from the alternative data collection vehicle group.

15. The apparatus according to claim 11, wherein:
when a fault code is received from the subject vehicle or from one of the alternative data collection vehicle group, a control operation is performed such that the subject vehicle data or the vehicle data corresponding to the fault code is excluded from data collection.

16. The apparatus according to claim 11, wherein the group criterion determination unit determines whether there is a network overload with the subject vehicle.

17. The apparatus according to claim 11, wherein the group criterion determination unit determines whether a quality of the vehicle data received from the subject vehicle is lower than a reference value.

18. The apparatus according to claim 11, wherein the predefined group criterion comprises at least one of information about a location of the vehicle, information about a road on which the vehicle is currently driven, information about a driving condition of the vehicle, and information about a vehicle model and vehicle specifications.

19. The apparatus according to claim 11, wherein the overlapped feature is not duplicated or copied in the storage, a link is established to an address in which actual vehicle data of the data item is stored so as to assign the overlapped feature to the subject vehicle data.

* * * * *